US006998227B2

(12) United States Patent
Youngblood et al.

(10) Patent No.: US 6,998,227 B2
(45) Date of Patent: Feb. 14, 2006

(54) COLOR DEVELOPER CONCENTRATE FOR COLOR FILM PROCESSING

(75) Inventors: Michael P. Youngblood, Rochester, NY (US); Thomas E. Lowe, Mendon, NY (US); Terrence R. O'Toole, Webster, NY (US); Charles M. Darmon, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/892,951

(22) Filed: Jul. 16, 2004

(65) Prior Publication Data

US 2006/0014112 A1 Jan. 19, 2006

(51) Int. Cl.
*G03C 7/413* (2006.01)

(52) U.S. Cl. ..... 430/466; 430/467; 430/486; 430/490; 430/492

(58) Field of Classification Search ..... 430/466, 430/467, 486, 490, 492
See application file for complete search history.

(56) References Cited

U.S. PATENT DOCUMENTS

| | | | | |
|---|---|---|---|---|
| 5,110,713 | A * | 5/1992 | Yoshida et al. | 430/372 |
| 5,273,865 | A | 12/1993 | Loiacono et al. | 430/490 |
| 5,891,609 | A | 4/1999 | Papai | 430/466 |
| 5,914,221 | A | 6/1999 | Kim et al. | 430/466 |
| 6,077,651 | A | 6/2000 | Darmon et al. | 430/466 |
| 6,664,034 | B2 | 12/2003 | Keyes et al. | 430/423 |

FOREIGN PATENT DOCUMENTS

| | | |
|---|---|---|
| EP | 0 528 406 A1 | 2/1993 |
| WO | WO 02/25371 | 3/2002 |

* cited by examiner

*Primary Examiner*—Hoa Van Le
(74) *Attorney, Agent, or Firm*—J. Lanny Tucker

(57) ABSTRACT

An aqueous, homogeneous, single-part color developing concentrate comprises a color developing agent in free base form and an organic antioxidant. The concentrate also includes a water-miscible or water-soluble organic co-solvent and a quaternary ammonium salt to enhance its stability. The concentrate can be used to make a working strength processing solution, or it can be used as a replenishing composition with proper dilution, and is particularly useful for processing color negative or color reversal photographic silver halide films.

17 Claims, No Drawings

COLOR DEVELOPER CONCENTRATE FOR COLOR FILM PROCESSING

FIELD OF THE INVENTION

The present invention relates to single-part, homogeneous photographic color developing concentrate useful for providing color images in color photographic materials and to a method for providing such color images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (Ishikawa et al.), U.S. Pat. No. 5,354,646 (Kobayashi et al.) and U.S. Pat. No. 5,660,974 (Marrese et al.).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and water, a homogeneous color developing composition can usually be obtained for the working strength solution in the processing machine.

Problem to be Solved

There is a desire in the industry to reduce the number of parts used to prepare color developing compositions, and particularly to prepare replenishing solutions. A wide range of compositions is described in the art or commercially available as "ready to use" solutions, concentrates or dry formulations. Liquid concentrates have only to be diluted with water to provide a working strength solution. Dry formulations need only be dissolved in water. For example, EP 0 793,141 A1 (Chugai Photo) describes a two-part color developing composition that can be supplied in either solid or liquid form.

It is generally known that the concentrations of various photochemicals used in a photographic processing bath must lie within certain narrow limits in order to provide optimal performance. The most important solvent for such photoprocessing is water. Most inorganic salts can be readily dissolved in water while the organic photochemicals in such processing baths usually have suitable solubility in water at the desired operating concentrations.

However, water is both an asset and a major problem of ready-to-use and some concentrated photographic compositions because of its presence in high quantity. As a result, the costs of manufacturing, transport and storage of such compositions are steadily growing. Normally, the user of photochemical compositions has water available in which individual photochemicals could be mixed or diluted, but this is usually not practical for a number of reasons. The exact composition of the photochemicals is not readily determined by a common user and manufacturers are not likely to readily provide their formulations for such a purpose. Moreover, even if the formulations are known, mixing mistakes may result in poor photoprocessing results.

For these reasons, there is a trend in the photographic industry to provide photoprocessing compositions (including color developing compositions) in concentrated form. Moreover, there has been a desire in the industry to provide compositions that can be used right out of their containers without the need for mixing various components such as in what are known as "automatic replenishing" processors.

The industry has investigated the use of both concentrates and solid mixtures (including powders and tablets). In most cases, concentrates are convenient to use but may have high packaging costs compared to powders or be in the form of slurries or two-phase mixtures. Powders permit high concentration, but not every photochemical composition can be dried into a stable powder. In addition, powders present problems of dust, separate packaging needs, and more troublesome metering or mixing procedures. Not all dry processing compositions are readily dissolved in water.

The common color developing compositions used to provide color images in color negative films are typically obtained by combining three "parts" into a single solution. Currently, the conventional antioxidant, hydroxylamine sulfate, must be kept separated from sulfites until they are used in processing. Similarly, the conventional color developing agent, 4-(N-ethyl-N-β-hydroxyethylamino)-2-methylaniline sulfate (KODAK Color Developing Agent CD-4) must be kept at low pH for solubility purposes, but a low pH environment is not suitable for other essential photoprocessing chemicals.

The casual observer might consider that all of the conventional "parts" used to provide color developing compositions might be readily combined to form a single-part homogeneous composition. As one skilled in the art would know, this is not easy. Interactions among and deterioration of photochemicals are magnified in concentrated form, and the resulting action on processed photographic materials may be undesirable.

Some color developing compositions are commercially available in single-part formulations, but because of the presence of precipitates (such as in slurries) or multiple solvent phases, they require vigorous agitation or mixing before use. In addition, the presence of the precipitates or slurries may be unattractive to some users and other users may not have suitable equipment for proper agitation or mixing.

Ready-to-use color developing compositions are described in U.S. Pat. No. 5,273,865 (Loiacono et al) as useful for rapid access processing of photographic elements having high silver bromide emulsions.

A very useful single-part color developing composition that is homogeneous, concentrated, and stable is described in U.S. Pat. No. 6,077,651 (Darmon et al.). These concentrated compositions are most useful for processing color photographic papers.

U.S. Pat. No. 6,664,036 (Lowe et al.) describes useful homogeneous, single-part color developers for color negative film processing in which the color developers also contain a stabilizing charged organic co-solvent.

Glycols are useful organic co-solvents that allow all the components of color developers to be dissolved in a single part concentrate. These compositions, when diluted to working strength, contain residual glycol in significant concentration and the glycol can cause undesirable sensitometric effects particularly with color negative films. These effects are typically observed as contrast changes in one or more color records, resulting in contrast mismatches among the color records.

There is a continuing need in the photographic industry for a single-part color developing composition that is homogeneous, concentrated, stable, and useful particularly for processing color negative films without the undesirable sensitometric effects observed with some organic co-solvents. The present invention is directed to meeting this need in the art.

SUMMARY OF THE INVENTION

This invention provides an advance in the art with an aqueous, homogeneous, single-part color developing concentrate having a pH of from about 9 to about 13 and comprising:

a) from about 0.05 to about 0.35 mol/l of an N,N-dialkyl-p-phenylenediamine color developing agent in free base form, b) from about 0.01 to about 0.5 mol/l of an organic antioxidant composition for the color developing agent that comprises an N,N-dialkyl- or N,N-diarylhydroxylamine derivative, and c) a water-miscible or water-soluble organic co-solvent that has a molecular weight of from about 100 to about 400, is present in the concentrate at a concentration such that the weight ratio of water to the organic co-solvent is from about 1:1 to about 3:1, and d) from about 0.002 to about 0.25 mol/l of a quaternary ammonium salt having a molecular weight of from about 75 to about 300.

In preferred embodiments, the present invention provides an aqueous, homogeneous, single-part color developing concentrate having a pH of from about 10 to about 11 and comprising:

a) from about 0.05 to about 0.25 mol/l of 4-(N,N-diethyl)-2-methylaniline hydrochloride (KODAK Color Developing Agent CD-2), 4-(N-ethyl-N-methanesulfonamidoethyl)-2-methylaniline sesquisulfate (KODAK Color Developing Agent CD-3), or 4-(N-ethyl-N-β-hydroxyethyl)-2-methylaniline sulfate (KODAK Color Developing Agent CD-4), each in free base form, b) from about 0.05 to about 0.25 mol/l of an organic antioxidant composition for the color developing agent that consists essentially of N,N-diethylhydroxylamine, N,N-bis(ethylenesulfonato)hydroxylamine, N,N-bis(2,3-dihydroxypropyl)-hydroxylamine, or N-isopropyl-N-ethylsulfonatohydroxylamine, c) a water-miscible or water-soluble co-solvent that is ethylene glycol, n-propylene glycol, diethylene glycol, di-n-propylene glycol, triethylene glycol, 1,2-butanediol, glycerol, 1,3-butanediol, or a mixture thereof, and is present in the concentrate at a concentration such that the weight ratio of water to the organic co-solvent is from about 1.5:1 to about 2.5:1, e) a carbonate buffering agent, and f) from about 0.005 to about 0.15 mol/l of tetramethyl ammonium chloride, tetraethyl ammonium chloride, tetra-n-propyl ammonium, chloride, tetra-n-butyl ammonium chloride, ethyltrimethyl ammonium chloride, n-propyltrimethyl ammonium chloride, n-butyltrimethyl ammonium chloride, 2-hydroxy-ethyltrimethyl ammonium chloride, or a mixture thereof.

This invention also provides a photographic processing chemical kit comprising:

I) the aqueous, homogeneous, single-part color developing concentrate of this invention described herein, and II) one or more of the following compositions:

a photographic bleaching composition, a photographic bleach/fixing composition, a photographic fixing composition, or a photographic stabilizing or final rinsing composition.

Further, this invention provides a method for providing a color photographic image comprising:

A) contacting a color negative or color reversal photographic silver halide film with a color developing solution that is obtained by diluting, at least 2.5 times, the aqueous, homogeneous, single-part color developing concentrate of this invention described herein. This method can further include the step(s) of:

B) desilvering the color developed color negative or color reversal photographic silver halide film.

The single-part color developing concentrate of this invention offer a number of advantages over the photochemical compositions currently available or known in the art. Our concentrate has minimal water, resulting in considerable savings in manufacturing, shipping and storage costs. In addition, it is a homogeneous composition, meaning that it is free of precipitates, slurries or multiple solvent phases. It does not require vigorous agitation prior to use, and can be immediately and readily metered into a photographic processing tank or bath with minimal instruction or possibility of mistake. For example, the concentrate can be used in "automatic replenishing" processors where the processing composition is diluted and used as needed. Importantly, it provides a single-part composition so the mixing of multiple parts, whether liquid or solid, is avoided.

Concentrate stability is provided by the presence of a particular organic nonionic co-solvent that has a critical molecular weight of from about 100 to about 400. This organic co-solvent is present at a concentration such that the weight ratio of water to the organic co-solvent is from about 1:1 to about 10:1.

The possible adverse sensitometric effects of residual organic co-solvents on processed materials is reduced or eliminated by the presence of specific quaternary ammonium salts in the color developing concentrate.

DETAILED DESCRIPTION OF THE INVENTION

The homogeneous, single-part color developing concentrate of this invention is prepared by making an aqueous solution of one or more suitable color developing agents and the other chemical components described herein. Initially, the color developing agent is generally in the form of a sulfate salt.

In this environment, especially at high alkalinity, alkali metal ions and sulfate ions form a sulfate salt that is precipitated in the presence of the organic co-solvent. The precipitated sulfate salt can then be readily removed using any suitable liquid/solid phase separation technique (including filtration, centrifugation or decantation). The color developing agent is therefore provided in "free base" form. Preferably, the resulting color developing concentrate is essentially sulfate ion free (meaning less than 0.005 mol/l of sulfate ion).

The color developing agents that are well known in the art as compounds that, in oxidized form, will react with dye forming color couplers in the processed materials. Such color developing agents are p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011). This reference will be referred to hereinafter as *"Research Disclosure"*.

Preferred color developing agents include, but are not limited to, 4-(N,N-diethyl)-2-methylaniline hydrochloride (KODAK Color Developing Agent CD-2), 4-(N-ethyl-N-methanesulfonamidoethyl)-2-methylaniline sesquisulfate (KODAK Color Developing Agent CD-3), or 4-(N-ethyl-N-β-hydroxyethyl)-2-methylaniline sulfate (KODAK Color Developing Agent CD-4), and others readily apparent to one skilled in the art. KODAK Color Developing Agents CD-2 and CD-4 are particularly useful in the practice of this invention.

In order to protect the color developing agents from oxidation, one or more organic antioxidants are included in the color developing concentrates in an antioxidant composition. Inorganic antioxidants can also be included in these antioxidant compositions or mixtures of inorganic and organic antioxidants can be used. Many classes of useful inorganic antioxidants are known, including but not limited to, sulfites (such as sodium sulfite, potassium sulfite, sodium bisulfite, and potassium metabisulfite). Mixtures of sulfites can be used if desired.

Useful organic antioxidants includes certain hydroxylamine derivatives such as N,N-dialkyl- and N,N-diarylhydroxylamines. In some embodiments, at least one of the alkyl or aryl groups is substituted with one or more solubilizing groups such as sulfo, carboxy, hydroxy, or phospho groups. Preferably, the substituents are hydroxy or sulfo groups and more preferably, each alkyl group has the same type and number of substituents.

Substituted and unsubstituted hydroxylamine derivatives are described in U.S. Pat. No. 4,892,804 (Vincent et al.), U.S. Pat. No. 4,876,174 (Ishikawa et al.), U.S. Pat. No. 5,354,646 (Kobayashi et al.), U.S. Pat. No. 5,709,982 (Marrese et al.), and U.S. Pat. No. 5,646,327 (Burns et al.), the disclosures of which are all incorporated herein by reference, but the invention is not limited to these particular compounds.

Particularly useful N,N-dialkylhydroxylamines comprise alkyl groups that have 1 to 4 carbon atoms, and preferably 2 or 3 carbon atoms, at least one of which is substituted with a solubilizing group noted above. The alkyl groups can be the same or different and preferably, they are the same. Thus, the most preferred compounds are N,N-diethyl- or N,N-dipropyl (n- or iso-)hydroxylamines wherein one or both of the ethyl or propyl groups have one or more carboxy, hydroxy, or sulfo substituents. Particularly useful N,N-dialkylhydroxylamines include N,N-bis(ethylenesulfonato) hydroxyamine, N,N-bis(2,3-dihydroxypropyl)hydroxylamine, and N-isopropyl-N-ethylenesulfonatohydroxylamine. A useful unsubstituted hydroxylamine is N,N-diethylhydroxylamine.

A most preferred antiokidant composition consists essentially of one or more N,N-dialkylhydroxylamine derivatives as defined above.

The noted antioxidants (organic or inorganic) are either commercially available or prepared using starting materials and procedures described in the references noted above in describing hydroxylamines.

Buffering agents are generally present in the color developing concentrates of this invention to provide or maintain desired alkaline pH of from about 7 to about 13, preferably from about 8 to about 12, and more preferably from about 10 to about 11. These buffering agents are generally soluble in the organic co-solvent described herein and have a pKa of from about 9 to about 13. Such useful buffering agents include, but are not limited to, carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

The color developing concentrates of this invention also include one or more photographically inactive, water-miscible or water-soluble, organic co-solvents that are capable of dissolving color developing agents in their free base forms. Such organic co-solvents preferably have molecular weights of at least 100, and preferably of at least 120, and generally 400 or less and preferably 220 or less.

The amounts of water and organic co-solvent in the concentrate are carefully controlled to achieve all of the desired results and to insure a single-phase homogeneous concentrate. Thus, the concentrate of this invention is not a slurry and contains little or no precipitates. If there is too much water, phase separation may occur. If there is too much organic co-solvent, the buffering agent and other salts will precipitate. The water to organic co-solvent weight ratio is from about 1:1 to about 3:1 and preferably from about 1.5:1 to about 2.5:1.

Preferred organic co-solvents are ethylene glycol, n-propylene glycol, diethylene glycol, di-n-propylene glycol, triethylene glycol, 1,2-butanediol, glycerol, 1,3-butanediol, and mixtures thereof. Ethylene glycol and diethylene glycol are most preferred.

The concentrate of this invention also includes from about 0.002 to about 0.25 mol/l (preferably from about 0.005 to about 0.15 mol/l) of one or more quaternary ammonium salts, each having a molecular weight of from about 75 to about 300. Preferably, these are chloride or hydroxide salts.

Preferably, the quaternary ammonium salts can be represented by the following Structure I:

$$R_1(R_2)N^+(R_3)R_4\,X^- \qquad \text{(I)}$$

wherein $R_1$, $R_2$, $R_3$, and $R_4$ are independently aliphatic, heterocyclic, or carbocyclic radicals, or any two or three of said radicals can form a quaternary ring with the nitrogen atom, and $X^-$ is a monovalent anion. Compounds of Structure I must also meet the molecular weight requirement noted above.

$X^-$ can be any suitable monovalent ion such as a halide or small organic or inorganic ion such as an acetate as long as it does not form a precipitate in solution or deleteriously affect the action of the color developing concentrate. Preferably, $X^-$ is chloride or bromide Preferably, $R_1$, $R_2$, $R_3$, and $R_4$ are independently hydrocarbon groups each of which has 1 to 8 carbon atoms, including alkyl, aryl, alkenyl, or other hydrocarbon groups. More preferably, at least three of $R_1$, $R_2$, $R_3$, and $R_4$ are the same alkyl groups hydrocarbon groups having 1 to 8 carbon atoms.

Two or more of the radicals can form a quaternary ring with the nitrogen atom, such as pyridinium, piperidinium, pyrazinium, quinolinium, or morpholino ring.

Representative quaternary ammonium salts include nontrimethyl ammonium bromide, benzyltrimethyl ammonium chloride, a mixture of alkyltrimethyl ammonium bromides (also known as "Cetrimide"), myristyltrimethyl ammonium bromide, tetramethyl ammonium chloride, tetraethyl ammonium chloride, tetra-n-propyl ammonium, chloride, tetra-n-butyl ammonium chloride, ethyltrimethyl ammonium chloride, n-propyltrimethyl ammonium chloride, n-butyltrimethyl ammonium chloride, 2-hydroxy-ethyltrimethyl ammonium chloride, and mixtures thereof. Tetramethyl ammonium chloride is the most preferred compound.

The concentrate can include a quaternary ammonium that is tetraethyl ammonium chloride and is present in an amount of from about 0.003 to about 0.025 mol/l.

Alternatively, the concentrate can include a quaternary ammonium that is tetramethyl ammonium chloride and is present in an amount of from about 0.03 to about 0.25 mol/l.

Still again, the concentrate can include a quaternary ammonium that is 2-hydroxyethyltrimethyl ammonium chloride and is present in an amount of from about 0.03 to about 0.25 mol/l.

It is particularly useful to include a quaternary ammonium salt that is one or more of tetramethyl ammonium chloride, tetraethyl ammonium chloride, and 2-hydroxyethyltrimethyl ammonium chloride in an amount of from about 0.003 to about 0.25 mol/l.

The color developing concentrates can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with or without lithium, magnesium or other small cations), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The amounts of such additives are well known in the art also. Representative color developing concentrates of this invention are described below in the Examples.

The following TABLE I shows the general and preferred amounts of some desirable components of the color developing concentrates of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath.

TABLE I

| COMPONENT | CONCENTRATE CONCENTRATIONS |
|---|---|
| Color developing agent | 0.05–0.35 mol/l<br>(0.05–0.25 mol/l) |
| Hydroxylamine antioxidant | 0.01–0.5 mol/l<br>(0.05–0.25 mol/l) |
| Sulfite ions | 0–0.4 mol/l<br>(0.05–0.4 mol/l) |
| Quaternary ammonium salt | 0.003–0.25 mol/l<br>(0.005–0.15 mol/l) |

The color developing concentrates of this invention have utility to provide color development in an imagewise exposed color photographic silver halide element comprising a substantially transparent support and one or more silver halide emulsion layers containing an imagewise distribution of developable silver halide emulsion grains. A wide variety of types of photographic elements (color negative films, color papers, color reversal films, and color motion picture films containing various types of emulsions can be processed using the present invention, the types of elements being well known in the art (see *Research Disclosure*, noted above). The color developer concentrate is particularly useful for providing color negative images in color negative photographic silver halide films.

The processed color negative films may have a magnetic recording layer, or stripe, on the support opposite the silver halide emulsion layer(s). Formulations for preparing magnetic recording layers are also well known in the art, as described for example, in Research Disclosure, publication 34390, November, 1992, U.S. Pat. No. 5,395,743 (Brick et al.) and U.S. Pat. No. 5,397,826 (Wexler), and Japanese Kokai 6-289559 (published Oct. 18, 1994), all incorporated herein by reference. While the magnetic recording layer can cover only a portion of the surface of the support, generally it covers nearly the entire surface, and can be applied using conventional procedures including coating, printing, bonding, or laminating.

Various supports can be used for such color films processed according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane4,4'-dicarboxylate and poly(butylene terephthalate) are preferred. These materials can be subbed or unsubbed and coated with various antihalation, antistatic, or other non-imaging layers as is known in the art. Particularly useful antistatic layers on the backside of the materials include vanadium pentoxide in a suitable binder.

Representative photographic color negative films that can be processed to advantage using the present invention include, but are not limited to, KODAK GOLD® Color Films, KODAK ROYAL GOLD® Color Films, KODAK HD® Color Films, KODAK MAX® Color Films, KODAK ADVANTIX® Color Films, KODAK PORTRA® Color Films, AGFA VISTA Color Films, KONICA CENTURIA Color Negative Films, FUJI SUPERIA and NEXIA Color Films, and LUCKY Color Films. Other elements that could be used in the practice of this invention would be readily apparent to one skilled in the art.

Some specific commercially available color reversal photographic films that can be processed using this invention include EKTACHROME® Color Reversal Films (Eastman Kodak Company), FUJICHROME Color Reversal Films (Fuji Photo Film Co., Ltd.), AGFACHROME Color Reversal Films (AGFA), and KONICACHROME Color Reversal Films (Konica).

The photographic color films processed in the practice of this invention can be single or multilayer color films. Multilayer color negative films typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure*, noted above. Included within such teachings in the art is the use of various classes of cyan, yellow and magenta color couplers that can be used with the present invention (including pyrazolone and pyrazolotriazole type magenta dye forming couplers).

Color development of an imagewise exposed color negative or reversal photographic silver halide film is carried out by contacting the film with a color developing concentrate of this invention, or with a color developing solution prepared from it, under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films (see for example, *Research Disclosure*, noted above).

Color reversal films usually require additional processing steps as required in the conventional Process E-6 processing method. The conditions and solutions generally used for processing color reversal films are well known. The typical sequence of steps includes first development (black-and-white development), reversal processing step, color developing, bleaching, fixing, and stabilizing. There may be various washing steps between other steps, as well as a pre-bleach step or conditioning step before bleaching. Alternatively, stabilizing can occur between color developing and bleaching. Many details of such processes are provided in U.S. Pat. No. 5,552,264 (Cullinan et al.), incorporated herein by reference.

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al.) and publications noted therein.

Color development is generally followed with one or more desilvering steps including one or more bleaching and fixing steps, or bleach/fixing step, using suitable silver bleaching and fixing agents.

Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure*, noted above, and U.S. Pat. No. 5,582,958 (Buchanan et al.) and U.S. Pat. No. 5,753,423 (Buongiorne et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP 0 532,003A1, and ethylenediamine monosuccinic acid and similar compounds as described in U.S. Pat. No. 5,691,120 (Wilson et al.).

The processing time and temperature used for each processing step of the present invention are generally those conventionally used in the art (such as for the conventional Process C-41, Process E-6 and Process K-14). For example, color development is generally carried out at a temperature of from about 20 to about 60° C. (preferably from about 35 to about 55° C.). The overall color development time can be up to 40 minutes, preferably from about 75 to about 450 seconds, and more preferably for less than 195 seconds.

The color developing concentrate of this invention can be formulated into a working strength solution or replenisher by suitable dilution of up to 12 times. Generally, the dilution rate is at least 2.5 times and up to 10 times, using water as a common diluent. Dilution can occur during or prior to processing.

The color developing composition of this invention can be replenished by the same or different aqueous, homogeneous, single-part color developing concentrate.

In one embodiment of this invention, the color developing concentrate is one chemical formulation in a photographic processing chemical kit that can include one or more other photographic processing compositions (dry or liquid) including, but not limited to, a photographic bleaching composition, a photographic bleach/fixing composition, a photographic fixing composition, and a photographic stabilizing or rinsing composition. Such additional compositions can be formulated in concentrated or working strength solutions, or provided in dry form (for example, as a powder or tablet). The processing kits can also include various processing equipment, metering devices, processing instructions, silver recovery devices and other conventional materials as would be readily apparent to one skilled in the art.

The color images obtained using the present invention can be digitized at any stage or step of the process. The digital images can then be manipulated, stored, or transmitted in any suitable manner that would be readily apparent to one skilled in the art. Such digitization may be suitable for minilab or "kiosks" where users may obtain an analog image, digital image (such as on a CD or compact disc), or both.

The following examples are provided to illustrate the practice of this invention and not to limit it in any way. Unless otherwise indicated, percentages are by weight.

EXAMPLES 1 & 2

Color Negative Film Developing Concentrate

Concentrates of this invention (124 ml) were prepared in the following manner:

Pre-Mix 1: A solution of sodium hydroxide (50% solution, 3.04 g) was added to a solution of 4-(N-ethyl-N-2-hydroxyethyl)-2-methylphenylenediamine sulfate (CD-4, 5.88 g) and N,N-diethylhydroxylamine antioxidant (0.1 g) in water (4.5 g). With stirring, diethylene glycol (30 g) was then added, and a precipitate of sodium sulfate was observed. This precipitate was filtered out of the solution, washed with 16 g of diethylene glycol, and discarded.

Pre-mix 2: To 20.00 g of water were added 6.50 g of diethylenetriaminepentaacetic acid, pentasodium salt (40% in water), 0.40 g of potassium bromide, 6.60 g of potassium bicarbonate, 50.0 g of potassium carbonate (47% in water), 10.13 g of potassium sulfite (45% in water), 0.20 g of tetraethyl ammonium chloride, and 12.0 g of 2,2'-(hydroxyimino) bis(ethanesulfonic acid), disodium salt (25% in water). The resulting composition was stirred until it was homogeneous.

Pre-mix 1 and Pre-mix 2 were then combined with stirring and packaged as a color developing concentrate, having a total volume of 124 ml. This color developing concentrate (Example 1) was homogeneous (single-phase) and essentially free of all sulfate ions. TABLE II is a summary of the Example 1 concentrate as well as an Example 2 color developing concentrate that was prepared identically except that 1.5 g of tetramethyl ammonium chloride was substituted for the tetraethyl ammonium chloride.

TABLE II

| | Example 1 | Example 2 |
|---|---|---|
| 4-(N-ethyl-N-2-hydroxyethyl)-2-methylphenylenediamine[a] | 0.16 mol/l as sulfate salt | 0.16 mol/l as sulfate salt |
| N,N-Diethylhydroxylamine | 0.0089 mol/l | 0.0089 mol/l |
| Sodium hydroxide (50% solution) | 24.5 g/l | 24.5 g/l |
| Diethylene glycol | 371 g/l | 371 g/l |
| Diethylenetriaminepentaacetic acid pentasodium salt (40% in water) | 52 g/l | 52 g/l |
| Potassium bromide | 3.2 g/l | 3.2 g/l |
| Potassium bicarbonate | 53 g/l | 53 g/l |
| Potassium carbonate (47% in water) | 400 g/l | 400 g/l |
| Potassium sulfite (45% in water) | 82 g/l | 82 g/l |
| Tetraethyl ammonium chloride | 0.0097 mol/l | 0 |
| Tetramethyl ammonium chloride | 0 | 0.11 mol/l |
| 2,2'-(Hydroxyimino) bis(ethanesulfonic acid) disodium salt (25% in water) | 0.080 mol/l | 0.080 mol/l |
| Weight ratio of water to organic solvent | 1.7:1 | 1.7:1 |

[a]Color developing agent was added as the sulfate salt, but was present in the concentrate as the p-phenylenediamine free base

EXAMPLE 3

Working Strength Color Developers and Photographic Effects

Working strength color developer solutions were prepared as shown in the following TABLE III. Solution A represents the working strength solution that was formed by dilution of the Example 1 concentrate plus addition, as is customary, of potassium bromide to make a fresh startup tank. Solution B represents a Comparative solution that contained diethylene glycol organic solvent but no quaternary ammonium salt. Solution C was a reference solution that contained neither diethylene glycol nor a quaternary ammonium salt.

TABLE III

| | Solution A (Invention) | Solution B (Comparative) | Solution C (Reference) |
|---|---|---|---|
| 4-(N-ethyl-N-2-hydroxyethyl)-2-methylphenylenediamine sulfate | 0.020 mol/l | 0.020 mol/l | 0.020 mol/l |
| Diethylene glycol | 46 g/l | 46 g/l | 0 |
| Diethylenetriaminepenta-acetic acid pentasodium salt (40% in water) | 6.50 g/l | 6.50 g/l | 6.50 g/l |
| Potassium bromide | 1.30 g/l | 1.30 g/l | 1.30 g/l |
| Potassium bicarbonate | 6.60 g/l | 6.60 g/l | 6.60 g/l |
| Potassium carbonate (47% in water) | 50.00 g/l | 50.00 g/l | 50.00 g/l |
| Potassium sulfite (45% in water) | 10.13 g/l | 10.13 g/l | 10.13 g/l |
| Tetraethyl ammonium chloride | 0.0012 mol/l | 0 | 0 |
| 2,2'-(Hydroxylmino) bis(ethanesulfonic acid) disodium salt (25% in water) | 0.010 mol/l | 0.010 mol/l | 0.010 mol/l |
| Final pH | 10.11 | 10.11 | 10.11 |

Five commercially available color negative photographic silver halide films were given a 21-step sensitometric exposure and processed using each of the color developer solutions in TABLE III (Solutions A, B, and C). The process, including use of the color developing solutions, followed the conventional Process C-41 protocol and conditions to obtain acceptable color images:

| | | |
|---|---|---|
| Color Development | 37.8° C. | 195 seconds |
| Bleaching | 37.8° C. | 240 seconds |
| Wash | 36° C. | 180 seconds |
| Fixing | 37.8° C. | 240 seconds |
| Wash | 36° C. | 180 seconds |
| Stabilizing | 37.8° C. | 60 seconds |

Bleaching, fixing, and stabilizing were carried out using commercially available KODAK FLEXICOLOR® chemical processing solutions appropriate for each processing step.

The red, green and blue optical densities at each exposure step were measured for each color negative film for each of the three color developing solutions. For each film, a "contrast mismatch" parameter was calculated to compare the effect of each of the two color developer solutions A and B to the reference color developer solution C. The contrast mismatch parameter is explained below. This parameter is calculated such that if either the images obtained using Solutions A or B match the images obtained using reference solution C perfectly, the contrast mismatch is set at 0%. Thus, the smaller the contrast mismatch, the better is the result.

The contrast mismatch parameters shown in the following TABLE IV demonstrate the photographic advantages of the color developer solution A that was derived from a color developing concentrate of this invention that contains diethylene glycol and a quaternary ammonium salt over the use of a color developing solution that contains only diethylene glycol.

TABLE IV

| Commercial Color Negative Film | Color Developer Solution | Contrast Mismatch (%) | Remarks |
|---|---|---|---|
| KODAK GOLD ® 200 | A | 6.6 | Invention |
| KODAK GOLD ® 200 | B | 8.4 | Comparison |
| KODAK ROYAL GOLD ® 200 | A | 6.2 | Invention |
| KODAK ROYAL GOLD ® 200 | B | 10.3 | Comparison |
| KODAK ROYAL GOLD ® 400 | A | 7.6 | Invention |
| KODAK ROYAL GOLD ® 400 | B | 11.1 | Comparison |
| KODAK MAX ® 400 | A | 6.1 | Invention |
| KODAK MAX ® 400 | B | 7.4 | Comparison |
| KODAK MAX ® ZOOM 800 | A | 4.3 | Invention |
| KODAK MAX ® ZOOM 800 | B | 4.3 | Comparison |

The "contrast mismatch" parameter is determined using the following set of equations:

For each 21-step red, green, and blue density vs. log exposure curve, a percent error in slope (test vs. aim) was calculated for nine three-step overlapping increments ranging from steps 5 to 16, according to Equation 1 (i=5 to 13):

$$e_i = \frac{(d_{i+3} - d_i)_{test} - (d_{i+3} - d_i)_{aim}}{(d_{i+3} - d_i)_{aim}} * 100 \quad \text{(Equation 1)}$$

A color contrast mismatch for each three-step increment is defined Equation 2.

$$m_i = \sqrt{0.5((e_{iR} - e_{iG})^2 + (e_{iG-eiB})^2 + (e_{iB} - e_{iR})^2)} \quad \text{(Equation 2)}$$

The total contrast mismatch over the entire range of steps 5 to 16 is given by Equation 3, and is tabulated in TABLE IV above. The aim curve was for the reference color developer solution, and the test curve was for the Invention or Comparative color developer solution.

$$ContrastMismatch = \sqrt{\frac{\sum_{5}^{13} m_i^2}{9}} \quad \text{(Equation 3)}$$

EXAMPLE 4

Seasoning with Color Developer Replenishers and Photographic Effects

A color developer replenisher (Replenisher A) was prepared by diluting 124 ml of the Example 2 concentrate B noted above (containing tetramethyl ammonium chloride) to 1 liter with water. A comparative color developer replenisher (Replenisher B) was prepared identically, except that tetramethyl ammonium chloride was omitted. The resulting color developer replenishers are described in the following TABLE V.

TABLE V

| | Replenisher A (Invention) | Replenisher B (Comparison) |
|---|---|---|
| 4-(N-ethyl-N-2-hydroxyethyl)-2-methylphenylenediamine sulfate | 0.020 mol/l | 0.020 mol/l |
| Diethylene glycol | 46 g/l | 46 g/l |
| Diethylenetriaminepentaacetic acid pentasodium salt (40% in water) | 6.50 g/l | 6.50 g/l |
| Potassium bromide | 1.30 g/l | 1.30 g/ |
| Potassium bicarbonate | 6.60 g/l | 6.60 g/l |
| Potassium carbonate (47% in water) | 50.00 g/l | 50.00 g/l |
| Potassium sulfite (45% in water) | 10.13 g/l | 10.13 g/l |
| Tetramethyl ammonium chloride | 0.014 mol/l | 0 |
| 2,2'-(hydroxyimino) bis(ethanesulfonic acid) disodium salt (25% in water) | 0.010 mol/l | 0.010 mol/l |
| Final pH | 10.11 | 10.11 |

A small volume processor initially containing a C-41 Fresh Tank (Using KODAK FLEXICOLOR® Developer Replenisher LoRR plus KODAK FLEXICOLOR® Developer Starter LoRR, 11.5 ml starter per liter of replenisher), was seasoned with three different color developer replenishers: Replenisher A, Replenisher B and KODAK FLEXICOLOR® Developer Replenisher LoRR ("Reference" color developer replenisher). The films processed during the seasoning was a equal mix of samples of KODAK GOLD® 200 and KODAK MAX® 400 color negative films. The replenishment rate was 49 ml of color developer replenisher per square foot of processed film (529 ml/m$^2$). After the color developer tank was seasoned to 95%, four color negative film samples (see TABLE VI below), exposed as described in Example 1, were processed so that the sensitometric performance of each seasoned color developer could be assessed. The contrast mismatch of the color developer tanks seasoned with Replenishers A and B were calculated against the reference developer seasoned to 95% with commercially available KODAK FLEXICOLOR Developer Replenisher LoRR. The results, shown in TABLE VI, indicate that for each processed film, a lower contrast mismatch was observed when color developer replenisher A was used compared to when comparative color developer replenisher B was used.

TABLE VI

| Color Negative Film | Replenisher | Contrast Mismatch (%) | Process |
|---|---|---|---|
| KODAK GOLD ® 200 | A | 8.4 | Invention |
| KODAK GOLD ® 200 | B | 9.6 | Comparison |
| KODAK ROYAL GOLD ® 200 | A | 5.7 | Invention |
| KODAK ROYAL GOLD ® 200 | B | 6.7 | Comparison |
| KODAK ROYAL GOLD ® 400 | A | 7.4 | Invention |
| KODAK ROYAL GOLD ® 400 | B | 8.6 | Comparison |
| KODAK MAX ® 400 | A | 8.2 | Invention |
| KODAK MAX ® 400 | B | 12 | Comparison |

The invention has been described in detail with particular reference to certain preferred embodiments thereof, but it will be understood that variations and modifications can be effected within the spirit and scope of the invention.

What is claimed is:

1. An aqueous, homogeneous, single-part color developing concentrate having a pH of from about 9 to about 13 and comprising:

a) from about 0.05 to about 0.35 mol/l of an N,N-dialkyl-p-phenylenediamine color developing agent in free base form, b) from about 0.01 to about 0.5 mol/l of an organic antioxidant composition for said color developing agent that comprises an N,N-dialkyl- or N,N-diarylhydroxylamine derivative, and c) a water-miscible or water-soluble organic co-solvent that has a molecular weight of from about 100 to about 400, is present in said concentrate at a concentration such that the weight ratio of water to said organic co-solvent is from about 1:1 to about 3:1, and d) from about 0.002 to about 0.25 mol/l of a quaternary ammonium salt that is tetramethyl ammonium chloride, tetraethyl ammonium chloride, tetra-n-propyl ammonium, chloride, tetra-n-butyl ammonium chloride, ethyltrimethyl ammonium chloride, n-propyltrimethyl ammonium chloride, n-butyltrimethyl ammonium chloride, 2-hydroxy-ethyltrimethyl ammonium chloride, or a mixture thereof.

2. The concentrate of claim 1 wherein said quaternary ammonium salt is present in an amount of from about 0.005 to about 0.15 mol/l.

3. The concentrate of claim 1 wherein said quaternary ammonium salt is tetraethyl ammonium chloride that is present in an amount of from about 0.003 to about 0.025 mol/l.

4. The concentrate of claim 1 wherein said quaternary ammonium salt is tetramethyl ammonium chloride or 2-hydroxyethyltrimethyl ammonium chloride that is present in an amount of from about 0.03 to about 0.25 mol/l.

5. The concentrate of claim 1 wherein said organic co-solvent is ethylene glycol, n-propylene glycol, diethylene glycol, di-n-propylene glycol, triethylene glycol, 1,2-butanediol, glycerol, 1,3-butanediol, or a mixture thereof.

6. The concentrate of claim 1 wherein said organic antioxidant has at least one carboxy, phosphono, sulfo, or hydroxy solubilizing group.

7. The concentrate of claim 1 wherein said organic antioxidant is diethylhydroxylamine, N,N-bis(ethylenesulfonato)hydroxyamine, N,N-bis(2,3-dihydroxypropyl)hydroxylamine, N-isopropyl-N-ethylenesulfonatohydroxylamine, or a mixture thereof.

8. The concentrate of claim 1 having a pH of from about 10 about 11 wherein said color developing agent is present in an amount of from about 0.05 to about 0.25 mol/l, said organic antioxidant is present in an amount of from about 0.05 to about 0.25 mol/l, and the weight ratio of water to said organic co-solvent is from about 1.5:1 to about 2.5:1.

9. The concentrate of claim 1 further comprising from about 0.05 to about 0.4 mol/l of sulfite ions.

10. The concentrate of claim 1 further comprising a buffering agent that is soluble in said organic co-solvent.

11. An aqueous, homogeneous, single-part color developing concentrate having a pH of from about 10 to about 11 and comprising:

a) from about 0.05 to about 0.25 mol/l of 4-(N,N-diethyl)-2-methylaniline hydrochloride, 4-(N-ethyl-N-methanesulfonamidoethyl)-2-methylaniline sesquisulfate, or 4-(N-ethyl-N-β-hydroxyethyl)-2-methylaniline sulfate, each in free base form, b) from about 0.05 to about 0.25 mol/l of an organic antioxidant composition for said color developing agent that consists essentially of N,N-diethylhydroxylamine, N,N-bis(ethylenesulfonato)hydroxylamine, N,N-bis(2,3-dihydroxypropyl)-hydroxylamine, or N-isopropyl-N-ethylsulfonatohydroxylamine, c) a water-miscible or water-soluble co-solvent that is ethylene glycol, n-propylene glycol, diethylene glycol, di-n-propylene glycol, triethylene glycol, 1,2-butanediol, glycerol, 1,3-butanediol, or a mixture thereof, and is present in said concentrate at a concentration such that the weight ratio of water to said organic co-solvent is from about 1.5:1 to about 2.5:1, e) a carbonate buffering agent, and f) from about 0.005 to about 0.15 mol/l of tetramethyl ammonium chloride, tetraethyl ammonium chloride, tetra-n-propyl ammonium, chloride, tetra-n-butyl ammonium chloride, ethyltrimethyl ammonium chloride, n-propyltrimethyl ammonium chloride, n-butyltrimethyl ammonium chloride, 2-hydroxy-ethyltrimethyl ammonium chloride, or a mixture thereof.

12. The concentrate of claim 11 wherein said color developing agent is 4-(N-ethyl-N-β-hydroxyethyl)-2-methylaniline sulfate said organic antioxidant composition for said color developing agent that consists essentially of N,N-diethylhydroxylamine, N,N-bis(ethylenesulfonato)hydroxylamine, or N-isopropyl-N-ethylsulfonatohydroxylamine, said water-miscible or water-soluble co-solvent is ethylene glycol, and said concentrate comprises tetramethyl ammonium chloride.

13. A photographic processing chemical kit comprising:

I) an aqueous, homogeneous, single-part color developing concentrate having a pH of from about 9 to about 13 and comprising:

a) from about 0.05 to about 0.35 mol/l of an N,N-dialkyl-p-phenylenediamine color developing agent in free base form, b) from about 0.01 to about 0.5 mol/l of an organic antioxidant composition for said color developing agent that comprises an N,N-dialkyl- or N,N-diarylhydroxylamine derivative, and c) a water-miscible or water-soluble organic co-solvent that has a molecular weight of from about 100 to about 400, is present in said concentrate at a concentration such that the weight ratio of water to said organic co-solvent is from about 1:1 to about 3:1, and d) from about 0.002 to about 0.25 mol/l of a quaternary ammonium salt that is tetramethyl ammonium chloride, tetraethyl ammonium chloride, tetra-n-propyl ammonium, chloride, tetra-n-butyl ammonium chloride, ethyltrimethyl ammonium chloride, n-propyltrimethyl ammonium chloride, n-butyltrimethyl ammonium chloride, 2-hydroxy-ethyltrimethyl ammonium chloride, or a mixture thereof, and II) one or more of the following compositions:

a photographic bleaching composition, a photographic bleach/fixing composition, a photographic fixing composition, or a photographic stabilizing or final rinsing composition.

14. A method for providing a color photographic image comprising:

A) contacting a color negative or color reversal photographic silver halide film with a color developing solution that is obtained by diluting, at least 2.5 times, an aqueous, homogeneous, single-part color developing concentrate having a pH of from about 9 to about 13 and comprising:

a) from about 0.05 to about 0.35 mol/I of an N,N-dialkyl-p-phenylenediamine color developing agent in free base form, b) from about 0.01 to about 0.5 mol/l of an organic antioxidant composition for said color developing agent that comprises an N,N-dialkyl- or N,N-diaryl-hydroxylamine derivative, and c) a water-miscible or water-soluble organic co-solvent that has a molecular weight of from about 100 to about 400, is present in said concentrate at a concentration such that the weight ratio of water to said organic co-solvent is from about 1:1 to about 3:1, and d) from about 0.002 to about 0.25 mol/l of a quaternary ammonium salt that is tetramethyl ammonium chloride, tetraethyl ammonium chloride, tetra-n-propyl ammonium, chloride tetra-n-butyl ammonium chloride, ethyltrimethyl ammonium chloride, n-propyltrimethyl ammonium chloride, n-butyltrimethyl ammonium chloride, 2-hydroxy-ethyltrimethyl ammonium chloride, or a mixture thereof.

15. The method of claim 14 further comprising:

B) desilvering said color developed color negative or color reversal photographic silver halide film.

16. The method of claim 14 wherein said color developing solution is replenished with the same aqueous, homogeneous, single-part color developing concentrate.

17. The method of claim 14 comprising digitizing the resulting color image.

* * * * *

UNITED STATES PATENT AND TRADEMARK OFFICE

CERTIFICATE OF CORRECTION

PATENT NO. : 6,998,227 B2
APPLICATION NO. : 10/892951
DATED : February 14, 2006
INVENTOR(S) : Michael P. Youngblood et al.

It is certified that error appears in the above-identified patent and that said Letters Patent is hereby corrected as shown below:

Column 16, Claim 12, line 20

12. The concentrate of claim 16 wherein said color developing agent is 4-(N-ethyl-N-b-hydroxyethyl)-2-methylaniline sulfate in free base form, said organic antioxidant composition for said color developing agent that consists essentially of N,N-diethylhydroxylamine, N,N-bis(ethylenesulfonato)hydroxylamine, or N-isopropyl-N-ethylsulfonatohydroxylamine, said water-miscible or water-soluble co-solvent is ethylene glycol, and said concentrate comprises tetramethyl ammonium chloride.

Signed and Sealed this

Fifteenth Day of August, 2006

JON W. DUDAS
*Director of the United States Patent and Trademark Office*